US010022599B1

(12) United States Patent
Jorgensen et al.

(10) Patent No.: US 10,022,599 B1
(45) Date of Patent: Jul. 17, 2018

(54) GOLF CLUB HEAD WITH INTERCHANGEABLE RAIL SYSTEM

(71) Applicant: Cobra Golf Incorporated, Carlsbad, CA (US)

(72) Inventors: Douglas Jorgensen, San Diego, CA (US); Cameron J. Day, Vista, CA (US); Steven M. Mitzel, San Marcos, CA (US)

(73) Assignee: COBRA GOLF INCORPORATED, Carlsbad, CA (US)

( * ) Notice: Subject to any disclaimer, the term of this patent is extended or adjusted under 35 U.S.C. 154(b) by 0 days.

(21) Appl. No.: 15/672,861

(22) Filed: Aug. 9, 2017

(51) Int. Cl.
*A63B 53/06* (2015.01)
*A63B 53/04* (2015.01)
*A63B 60/52* (2015.01)

(52) U.S. Cl.
CPC ..... *A63B 53/0466* (2013.01); *A63B 53/047* (2013.01); *A63B 60/52* (2015.10); *A63B 2053/045* (2013.01); *A63B 2053/0433* (2013.01)

(58) Field of Classification Search
CPC ..... A63B 2053/0433; A63B 53/0466; A63B 60/52; A63B 53/047; A63B 2053/045
See application file for complete search history.

(56) References Cited

U.S. PATENT DOCUMENTS

| | | | | |
|---|---|---|---|---|
| 3,680,868 | A * | 8/1972 | Jacob | A63B 53/0487 473/230 |
| 5,213,329 | A | 5/1993 | Okumoto et al. | |
| D410,057 | S | 5/1999 | Ortiz | |
| 5,938,540 | A | 8/1999 | Lu | |
| 6,123,627 | A | 9/2000 | Antonious | |
| D435,075 | S | 12/2000 | Ota | |
| 6,257,991 | B1 | 7/2001 | Ortiz | |
| 8,690,707 | B2 * | 4/2014 | Stites | A63B 53/0466 473/335 |
| 9,381,406 | B2 * | 7/2016 | Boggs | A63B 53/04 |
| 9,782,644 | B2 * | 10/2017 | Dolezel | A63B 53/047 |
| 2006/0094526 | A1 | 5/2006 | Reed | |
| 2006/0240905 | A1 * | 10/2006 | Haney | A63B 53/0487 473/313 |

FOREIGN PATENT DOCUMENTS

JP 11262548 A 9/1999

OTHER PUBLICATIONS

Medicus, "Blast Toughlie 15 degree", web page snapshot from May 27, 2017, from Medicus Kick X Golf, Vista, CA, from the internet on Mar. 2, 2018, using the "Internet Archive Wayback Machine" from https://web.archive.org/web/20170527080432/http://p.medicuskickx.com/products/display/737 (1 page).

* cited by examiner

*Primary Examiner* — Stephen Blau
(74) *Attorney, Agent, or Firm* — Brown Rudnick LLP; Mark S. Leonardo

(57) ABSTRACT

A golf club head with an interchangeable or reversible sole rail system having a rail member configured to be received within one or more channels formed on the club head. The rail system allows the player to employ rails along a surface of the club head to improve the interaction between the club head and the ground during the swing.

13 Claims, 4 Drawing Sheets

GOLF CLUB HEAD WITH INTERCHANGEABLE RAIL SYSTEM

TECHNICAL FIELD

The disclosure relates to a golf club head with an interchangeable rail system.

BACKGROUND

Golf courses comprise various types of terrain between the tee box and the hole. Standard forms of terrain include the fairway, the area between the tee box and the putting green. Fairways typically have short, evenly-cut grass. The rough refers to areas between the fairway and the out-of-bound markers, and also between a mowed apron surround the green and out of bounds. The grass there is high and coarse, making roughs a difficult area from which to hit. Terrain type influences the contact between sole of the club head and the ground, having a significant impact on the distance and direction the golf ball travels. For example, striking the golf ball from the rough slows the players swing speed and often causes the club head to twist prior to impact resulting in off-centered shots. The terrain type can also vary depending on the geographical location of the golf course. For example, the ground in some locations is very hard, and not porous; whereas the ground in other locations is very soft and the soil is well aerated.

Efforts to help the golfer hit the ball in the intended direction for the desired distance have resulted in golf clubs with larger striking faces. A larger striking face increases the contact area between the ball and the club head and is purported to help the golf club resist twisting as the club head interacts with the terrain. The presumption is that a club with a larger striking face will move in a straighter line along the swing plane, projecting the golf ball in a straight direction. However, these clubs do not necessarily resist twisting and certain types of terrain continue to disrupt the club head prior to contact with the ball, resulting in off-centered shots that propel the golf ball in unintended directions for undesirable distances. This is unsatisfactory to many golfers.

SUMMARY

A golf club head that has protruding rails that can be removed, flipped over, and re-attached to form a smooth surface. When the rails protrude from the sole of the club head, they provide a stabilizing interaction with turf or ground. The stabilized turf interaction helps shots that are hit from the rough to fly straight. In the other orientation, the club head has a smooth sole with a slightly higher center of gravity, which gives shots that bore forward and go a great distance. For shots hit from any troubled lie, distance and accuracy may be more important goal than turf interaction. Thus, a golfer may adjust the club head for optimum performance for the immediate environment and use the club to get great distance toward the green and to get out of the rough. The club head may include multiple, interchangeable rails (e.g., deep and shallow rails and/or straight and angled rails). Additionally, the rail attachment mechanism may be used to attach other mechanisms to the club head such as electronic devices such as shot trackers, batteries, identifying markers, or other features. A golfer may have a few different rail sets in which the rails have different ramps or slopes so that the club head can have, e.g., a bounce angle tailored to that golfer and to the golf course conditions.

The golf club may be provided with a variety of different rail pieces for the interchangeable rail system. For example, at least three different types of rail systems may be made available. A golf club head may be sold with a first rail member that includes no rails (on one side) and one or more rails on obverse side with a slight elevation; a second rail member that includes no rails and one or more rails with a medium elevation; and a third rail member that includes no rails and one or more rails with a high elevation. The collection of different rail members would allow the golfer to alter the golf club head to accommodate the immediate conditions of the course. Generally, a player would prefer a higher rail when shots are taken in longer rough or off softer ground while the player would use rails with a lower elevation when hitting off shorter grass or harder ground.

An embodiment of the club head includes a channel that runs along the body of the club and is configured to receive a separate rail piece. When the rail piece is inserted into the channel in a first orientation, one or more rails project from the club head body. The rail piece may include one or more individual rails, spaced apart from one another, so that each slides into a dedicated channel and the walls of each channel brace each individual rail along its length. Because each individual rail is braced along its length, the positioning of the rails on the club head exhibits exceptional stability during play. When swung through the rough, the rails provide controlled turf interaction and keep the club face straight and help the player maintain club head speed through the swing when playing off certain types of terrain. However, depending on the terrain and strike angle the player may prefer to use a club head without rails. To switch, the player simply detaches the rail piece from the channel, flips the rail piece over, and re-inserts the rail piece back into the channel in a second orientation.

Attaching the rail piece via an internal channel has clear advantages over alternative designs. When a rail piece is simply secured onto a recess (e.g., with a single screw that creates a natural pivot point), the club head is prone to moving, twisting, and bending because when a player attempts a shot he or she sometimes strikes hard surfaces such as rocks and pavement. The present invention eliminates this unwanted movement by securing the rail piece internally. Additionally, the shape of the rails can be designed to affect airflow; i.e. the height of the rail nearest the leading edge is slight and extends to a greater height towards the aft section of the club head.

In certain aspects, the invention provides a golf club head with a ball-striking face, a crown extending back from the face when the club head is at address, a sole extending back from the face to meet the crown, a hosel extending upwards from a heel side of the club head, and at least one channel extending on the surface of the body that is configured to receive a separate rail member comprising at least one extended rail by sliding the rail member into the channel. The rail member is configured to be reversibly attached to the channel such that when the rail member is slid into the channel in a first orientation, at least one rail projects from the club head, and when the rail member is attached in a second orientation, no rails are exposed and the sole of the club head is smooth. Preferably, the golf club head is a hollow, wood-type club head, such as the head for a driver, a fairway, hybrid or utility club; however, the rail system could also be used on a non-hollow club, such as an iron, wedge, or putter. The club head and rail member may be made from wood, metal, plastic, or a composite The channel may run along the sole of the golf club head from the striking face towards the rear of the club. The channel may be perpendicular to the striking face or slightly angled extending generally between the toe and the heel. Preferably, the channel will extend along the majority of the sole. At the end of the channel opposite to the striking face is an open end configured to receive the rail member by sliding the rail member into the open end.

The club head may include a recess adjacent the open end of the channel. Preferably, the recess is located adjacent the channel near the rear of the club. The recess should be configured to receive a fastener member. The fastener member may be designed to have a draft angle to complement the club head body such that when the fastener member is placed in the recess, the aerodynamic profile of the club head body is complete. The fastener member should be secured by a fastener, such as a clip, pin, or screw; and when fastened, the open end at the end of the channel should be closed off so as to secure the rail piece within the channel.

The rail member may comprise at least one extended rail having an elongated body with a proximal end, a distal end, a top side with at least one rail, and a bottom side with a flat surface. The rail may take on a variety of shapes and profiles so as to provide golfers with a choice regarding the features attached to the golf club head surface. Moreover, the rail member may comprise more than one extended rail. The extended rails may be connected at one end by a crossbar, and positioned such that they are approximately 1 cm to 8 cm apart and run generally parallel to one another. In preferred embodiments, the club head is a driver and the rails are spaced apart from one another by about 6 or 7 cm. In some embodiments, the extended rails are further configured to slide into channels, wherein the number of channels on the club head will be consistent with the number of extended rails that comprise the rail member.

The rail member may include a tongue on one or more sides corresponding to at least one groove inside the channel. When the rail member is slid into the channel the tongue will interact with the groove and function as a guide for sliding the rail piece into the channel and will secure the rail piece into the channel. The tongue-in-groove interaction is preferably preserved whether the rail piece is inserted in the first orientation or in the second orientation. The tongue-in-groove may be embodied as a single extended projection, but may be a series of dots, tabs, or any other means.

Preferably when the rail member is slid into the channel in the first orientation, the one or more rails provide a stabilizing turf interaction. When in the first orientation, the one or more rails project from the sole of the club to interact with the turf and function similar to a rudder on boat, keeping the club head face straight at impact so as to propel the golf ball in a straight, forward direction. Additionally, the one or more rails on the bottom of the club function as an additional layer between the sole of the club and the turf, preventing the striking face of the club from digging into the ground and thereby help the player maintain swing speed through impact. When in the second orientation, the one or more rails are not visible on the sole of the club. In the second orientation the sole of the club is substantially smooth.

The disclosure provides that the rail piece has a uniform or a non-uniform weight distribution. It is believed that the positioning of weights in the sole of the club head has substantial effects on the striking characteristics of the club. In order to improve these striking characteristics, one aspect of the present invention is that the rail piece may vary in weight and weight distribution in order to provide striking characteristics that best match the player's swing preferences.

DETAILED DESCRIPTION

The invention relates to a golf club head with an interchangeable or reversible rail system that allows the player to configure the sole of the golf club head to improve its movement across the turf. A detailed description of the present invention is disclosed herein. It should be understood that the embodiments described are exemplary and should not be interpreted as limiting the scope of the invention. The detailed description disclosed herein is merely intended to teach one skilled in the art how to make and/or use the invention.

Figure 1:
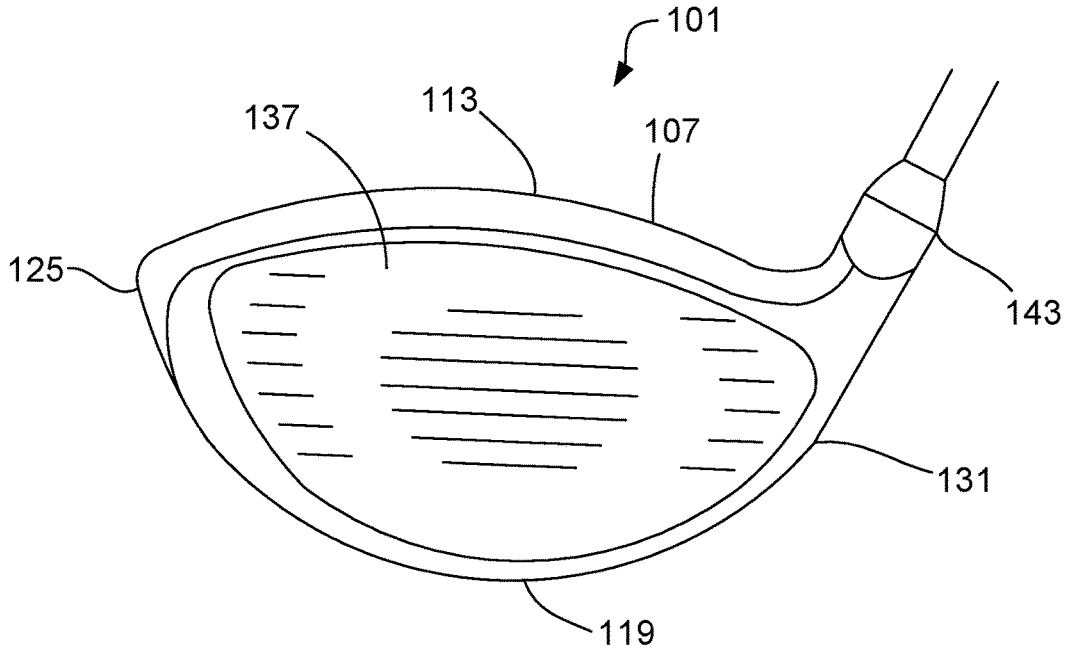
FIG. 1 shows a front view of the golf club head.

FIG. 1 shows a front view of the golf club head 101 according to the present invention. The club head 101 includes a body 107 defining a crown 113, a sole 119, a toe 125, a heel 131, and a ball striking face 137. The club head 101 is configured to attach to a shaft via a hosel 143 that extends upwards from the heel side of the body 107 when the club is at address. Preferably, the golf club head 101 is a wood or hybrid-type club; however, the invention may be employed on other types of clubs, such as an iron. The club head 101 may be formed from any suitable material, including metals, such as titanium, steel, aluminum, other metal alloy materials, composite or other non-metal materials, polymeric materials, and combinations of various materials. The club head 101 may be formed from one material i.e., a single cast or forged piece of metal or composite, or a combination of materials.

Figure 2:
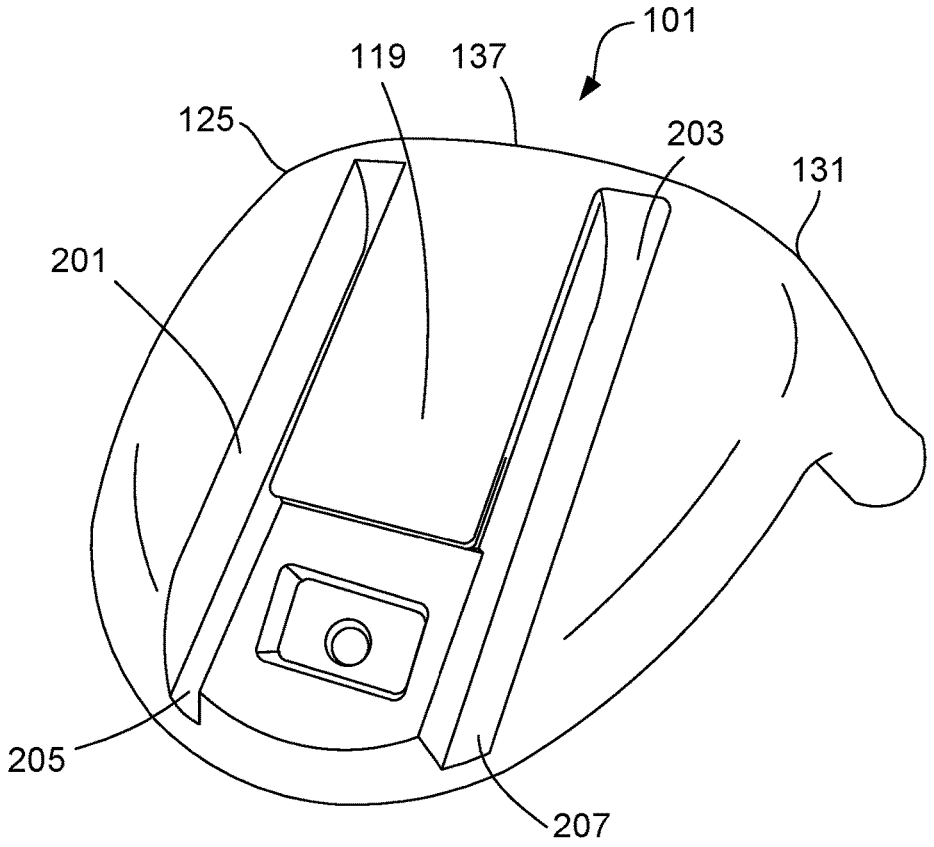
FIG. 2 shows a bottom view of the golf club head with the rail member removed.

FIG. 2 shows a bottom view of the club head 101 according to one embodiment. The sole 119 includes two channels 201, 203 that extend away from the striking face 137 between the toe 125 and the heel 131. The channels 201, 203 begin substantially near the striking face 137 and lengthen across a majority of the sole 119. The channels 201, 203 extend parallel to each other consistent with the extended rails 307, 309 of the rail member 301, which they are configured to receive (rail member 301 shown in FIG. 3). The channels 201, 203 include open ends 205, 207 opposite to the striking face 137 through which the rail member 301 may be inserted. The size and dimensions of the channels 201, 203 are configured to receive and secure the rail member 301. Thus, when the rail member 301 is inserted into the channels 201, 203, the channels 201, 203 will secure the rail member 301 along the length of the channels 201, 203.

The number and placement of the channels 201, 203 is not limited to the embodiment depicted. In some embodiments one or more channels may be angled relative to the striking face 137 to facilitate certain striking characteristics of the club head 101. The channels 201, 203 may extend across a majority of the sole 119 as in the depicted embodiment, or the channels 201, 203 may extend only partially across the sole 119.

Figure 3:
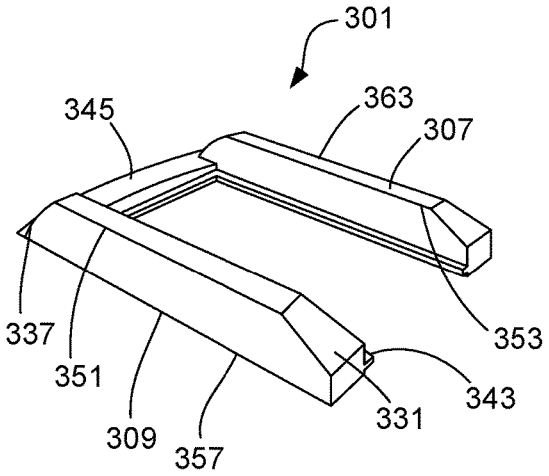
FIG. 3 gives a top view of the rail member.
Figure 4:
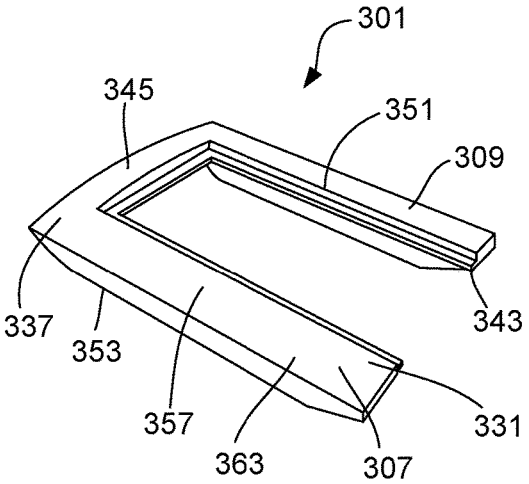
FIG. 4 gives a bottom view of the rail member.

FIGS. 3 and 4 show a top view and a bottom view of a rail member 301, respectively. The rail member 301 includes an elongated body 363 between a proximal end 331 and a distal end 337, two extended rails 307, 309 connected at the distal end 337 by a crossbar 345, a top surface comprising rails 351, 353 and an opposed flat surface 357 (shown more clearly in FIG. 4). The extended rails 307, 309 are separated 1 cm to 8 cm apart and extend in a parallel direction. The extended rails 307, 309 extend substantially across the sole 119 when inserted into their respective channels 201, 203. The dimensions of the rail member 301 are configured for sliding into the recessed channels 201, 203 on the club head 101. When the extended rails 307, 309 are slid into their individual channels 201, 203, the extended rails 307, 309 are secured along their length by the walls of the channels 201, 203. By securing the individual extended rails 307, 309 along their length by channels 201, 203, the rails 351, 353 exhibit exceptional stability during play.

The rail member 301 may be constructed from materials similar to those used in the golf club head 101. In some embodiments, the rail member 301 may be constructed from heavier materials designed to give the rail member 301 additional weight. For example, the rail member 301 may be made of tungsten or other similarly dense materials. By providing rail members 301 with different weights the user may optimize the weight distribution in the sole 119 and customize swing characteristics of the club head 101 simply by switching rail member 301. In some embodiments the rail member 301 may have a non-uniform weight distribution such that one end of the rail member 301 is heavier than the other in order to modify striking characteristics of the club head 101.

The rails 351, 353 along the top surface of the rail member 301, may take on a variety of shapes and profiles. In the depicted embodiment, the rails 351, 353 comprise a uniform profile that extends along the length of the rail member 301. In other embodiments the rails 351, 353 may extend only partially along the extended rails 307, 309 and comprise a non-uniform profile. The rails 351, 353 may take on various forms designed to improve the interaction of the club head 101 with the turf during the swing. For example, the rails 351, 353 may have a cross-section that is substantially rounded, square, trapezoidal, or circular. In addition, the ends of the rails 351, 353 where the rails 351, 353 join the extended rails 307, 309 may take on various degrees of steepness designed to provide for different turf interactions.

In some embodiments the extended rails 307, 309 of the rail member 301 are not connected by a crossbar 345. This allows the user to configure the club head 101 with rails 351, 353 of various sizes, weights, and orientations independently of one another; thus, increasing the number of customizable options available to the player in order to fine tune the sole 119 of the club head 101.

The rail member 301 is configured to be reversibly attached to the club head 101 by sliding the extended rails 307, 309 through open ends 205, 207 of respective channels 201, 203. To secure attachment, the extended rails 307, 309 include at least one tongue 343 along at least one side of the extended rail 307, 309 that corresponds to a groove 213 (see FIG. 5) within the inside wall of the respective channel 201, 203. The tongue 343 need not be one extended ridge, but may be a series of dots, tabs, or any other form with which one skilled in the art would recognize.

It should be understood that the features the rail member 301 provides the club head 101 are not restricted to rails 351, 353 and it is expected that the rail member 301 will be available in a variety of embodiments and offer a range of enhancements to the club head 101. The rail member 301 may be formed from a rubber or plastic that absorbs impact and protects the club head 101 when striking from or near hard surfaces. The rail member 301 may comprise light emitting diodes that light up when swinging. The rail member 301 may comprise acoustic features that make different sounds when the club head 101 is swung through the air. The rail member 301 may comprise training devices such as lasers or lights that project from the sole of the club in order for the player visualize his/her swing plane. Additionally, the rail member 301 may function as a lid or a cover for channels 201, 203 wherein the channels serve an alternative purpose, such as securing the club head 101 to other rail-like surfaces, e.g., a display rack.

Figure 5:
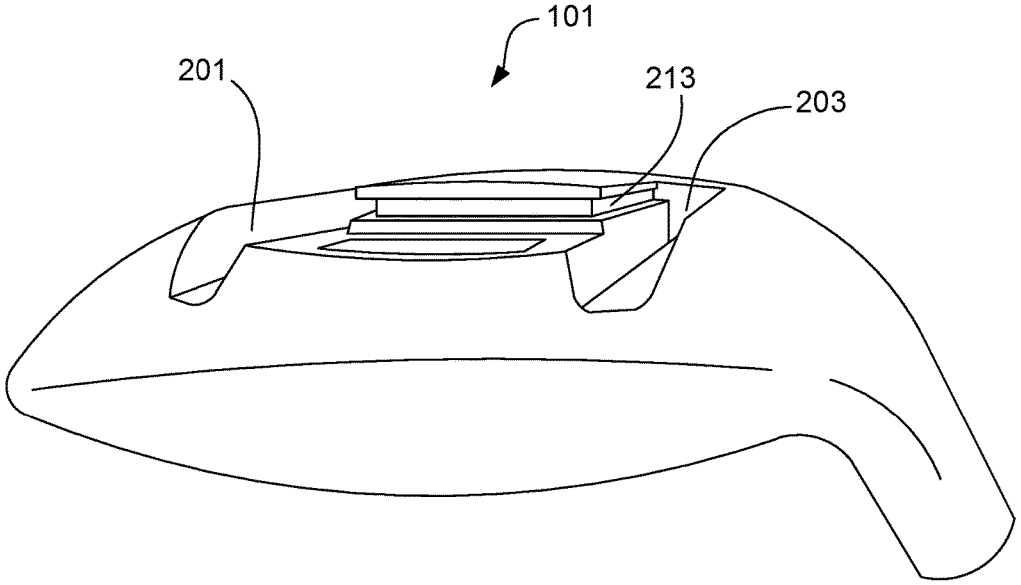
FIG. 5 provides a rear view of the golf club head with the rail member removed.

FIG. 5 shows a rear view of the club head 101 according to the preferred embodiment. When the extended rails 307, 309 are inserted into a corresponding channel 201, 203 the tongue 343 and groove 213 function as a guide and secure the rail member 301 to the sole 119 of the club head 101.

Figure 6:
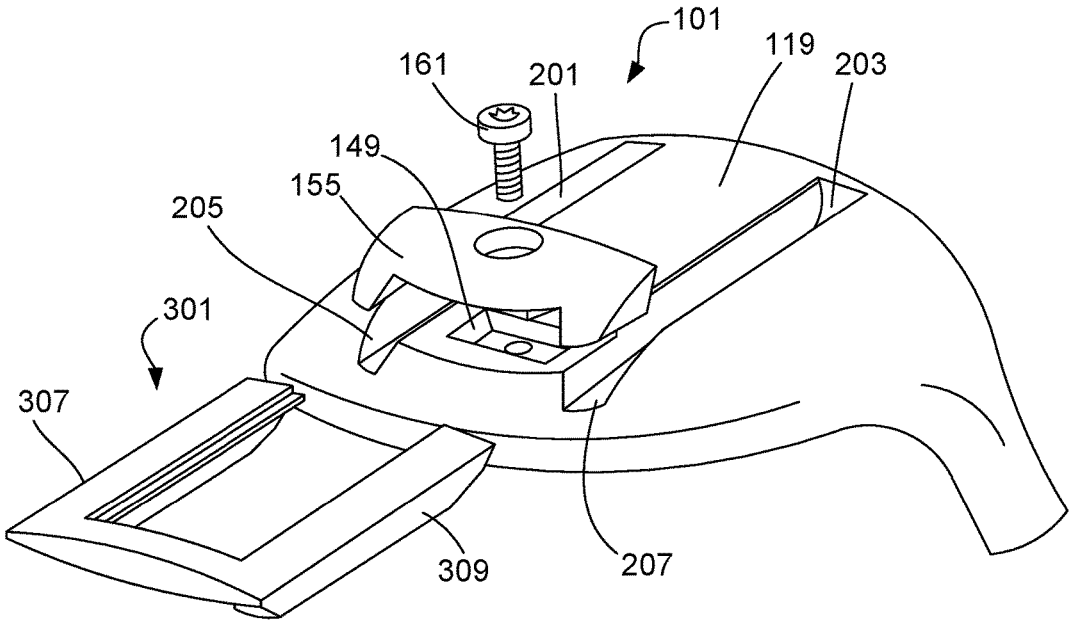
FIG. 6 shows a bottom view of the golf club head that includes the fastener member.

FIG. 6 shows a fastener member 155 configured to be removably secured within a recess 149 on the sole 119 according to the one embodiment. The recess 149 is adjacent to the open ends 205, 207 of the channels 201, 203. The fastener member 155 is secured within the recess 149 by a fastener 161 such as a screw or tab, and when fastened, closes off the open ends 205, 207 to secure the rail member 301 within the channels. In the depicted embodiment the fastener member 155 is beveled at one end so that when the fastener member is secured within the recess the club head 101 preserves an aerodynamic profile. Beveled should be understood to mean that the fastener member 155 is tapered off at one end, forming a draft angel, such that when the fastener member 155 is secured within the recess, the club head 101 comprises a rounded, rear profile. The fastener member 155 may be formed from materials similar to those used to make the club head 101. In some embodiments the fastener member 155 is constructed from denser materials to give the club head 101 added weight.

One aspect of the invention is that the user can change the sole 119 of the golf club head 101 to account for different types of terrain. The player can choose to use the golf club head with or without rails 351, 353 projecting from the sole 119 depending on the attack angle of the player's swing and turf conditions. The rail system on the sole 119 of the golf club head 101 can be changed by removing the rail member 301, flipping it over, and sliding the rail member 301 back into the channels 201, 203 on the sole 119 of the golf club head 101.

Figure 7:
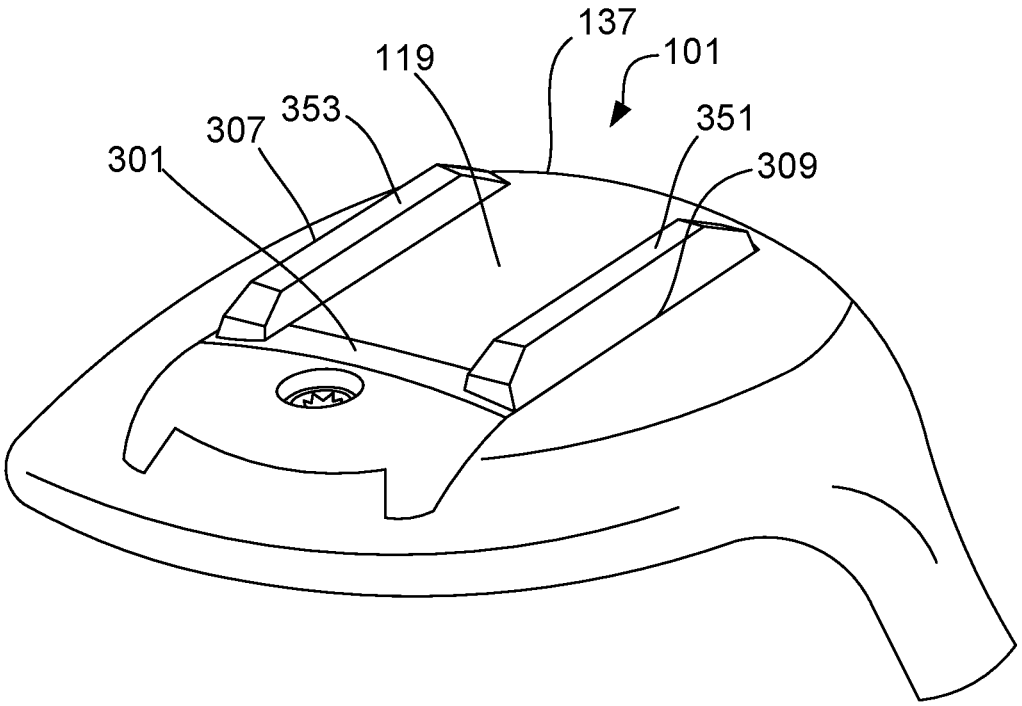
FIG. 7 shows the first orientation that the rail member may be attached to the club head.

FIG. 7 shows the rail member 301 attached to the club head 101 in the first orientation.

Figure 8:
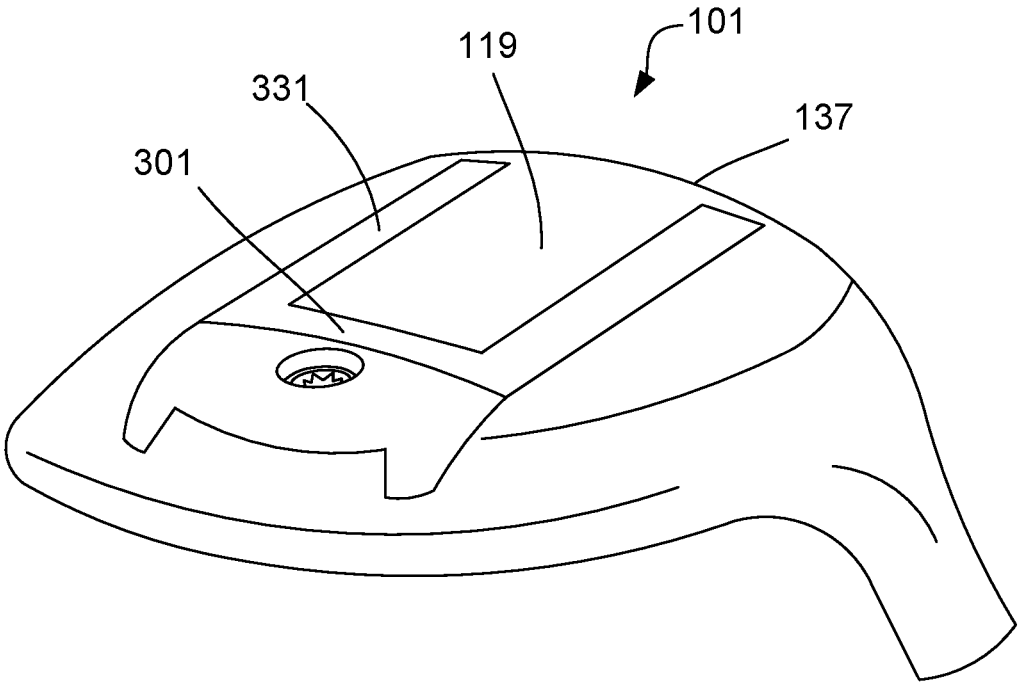
FIG. 8 shows the second orientation for attachment of the rail member.

FIG. 8 shows the rail member 301 attached to the club head 101 in the second orientation. When the rail member is attached in the first orientation, the rails project from the sole 119 of the club head 101. When the rail member 301 is inserted in the second orientation, the sole 119 of the club head 101 is substantially smooth. First orientation and second orientation may be understood to refer to two alternative orientations (out of two or more) in which the rail member may be attached to the club head.

FIG. 7 illustrates the first orientations that the rail member 301 may attach to the club head 101 according to one embodiment. When the rail member is attached in the first orientation, the rails 351, 353 along the surface of the extended rails 307, 309, project from the sole 119 of the club head 101. The rails 351, 353 project perpendicular to and extend across a majority of the sole 119. In this orientation, the rails 351, 353 provide a stabilizing turf interaction that is not provided when the rails 351, 353 are attached in the second orientation (see FIG. 8). During the swing, the rails keep the striking face 137 square at impact by guiding the club head 101 through the grass and resisting the twisting of the club head that often occurs when the club head interacts with the turf, particularly in long grass. The rails 351, 353 also provide an additional layer between the sole 119 of the club head 101 and the terrain, which prevents the club head 101 from digging into the ground and thereby enables the player to maintain swing speed through the shot. The height of the rails 351, 353 may be configured to make the striking face 137 either higher from the ground or lower to ground. Thus, by providing multiple rail members 301 the player can customize the sole 119 to best-fit the terrain.

When playing from terrain in which the rails 351, 353 are not desirable, the player may simply remove, flip, and re-attached the rail member 301 in the second orientation, shown in FIG. 8. The second orientation 507 is well suited for playing off surfaces in which it is preferable to keep the club head 101 close to the ground.

The player may decide whether to attach the rail member 301 in the first orientation or the second orientation (compare FIGS. 7 and 8) depending on the turf conditions, e.g., rough vs fairway. When the rail member 301 is slid into the channels 201, 203 in the first orientation, the rails 351, 353 provide a favorable turf interaction when striking a ball from the rough. The rails 351, 353 stabilize the club head 101 as it travels over the ground keeping the striking face 137 square at impact and projecting the ball in a straight direction.

Sometimes when a player attempts a shot, the club head 101 digs into the ground prior to striking the ball. This causes the club head 101 to lose speed prior to impact, hindering the player's ability to hit the ball a desirable distance. The rails 351, 353 enhance the player's ability to drive the ball longer distances by functioning as a barrier between the ground and the club head 101. The rails 351, 353 allow the club head to rake across the terrain with minimal reduction in club head speed. Thus, when the rails 351, 353 are down, the player is able to hit the ball longer distances.

When a player strikes a ball from the fairway, it is important that the striking face 137 be near the ground to facilitate contact between the striking face 137 and the golf ball. When the rail member 301 is inserted in the second orientation, the club head 101 hugs the ground more closely than when the rail member 301 is inserted into the club head 101 in a first orientation. Thus, when the player is hitting a ball off the fairway, the player may choose to insert the rail member 301 into the club in a second orientation, rather than a first orientation.

What is claimed is:

1. A golf club head comprising:

a body defining a crown, a sole, a toe, a heel, and a ball striking face;

a hosel extending upwards from the heel side of the body when at address;

at least one channel extending along a surface of the body; and a rail member comprising at least one extended rail, the rail member configured to be reversibly attached to the body by sliding the at least one extended rail into the at least one channel, wherein when the rail member is attached to the body in a first orientation, at least one rail has an outer surface with a protruding part above the surface of the body which is exposed and when the rail member is attached to the body in a second orientation, the at least one rail has the outer surface which is flush with the surface of the body with no protruding part above the surface of the body which is exposed.

2. The golf club head of claim 1, wherein the at least one channel extends along the sole generally perpendicular to the striking face, the at least one channel further comprising an open end opposite the striking face.

3. The golf club head according to claim 2, wherein when the rail member is inserted into the at least one channel the at least one extended rail slides along the length of the at least one channel, and the length of the at least one channel extends along the majority of the sole.

4. The golf club head of claim 2, wherein the body comprises a recess adjacent to the open end of the at least one channel, and a fastener member removably secured within the recess by a fastener.

5. The golf club head of claim 4, wherein when the fastener member is secured within the recess by the fastener, the fastener member closes off the open end and secures the attachment of the rail member within the at least one channel.

6. The golf club head of claim 4, wherein the fastener member further comprises a draft angle.

7. The golf club head according to claim 1, wherein when the rail member is inserted into the at least one channel a proximal end is secured generally near the striking face with the at least one extended rail extending towards the rear of the club.

8. The club head of claim 7, wherein when the rail member is inserted into the at least one channel in the first orientation, the at least one rail provides stabilizing turf interaction that is not provided when the rail member is inserted into the at least one channel in the second orientation.

9. The golf club head according to claim 7, wherein the rail member comprises a non-uniform weight distribution along its extent from the striking face towards the open end.

10. The golf club head of claim 1, further comprising a tongue extending along a side of the at least one extended rail and a corresponding groove along an inside surface of the at least one channel, wherein when the rail member is inserted into the at least one channel the tongue slides into the groove to function as a guide when sliding into the at least one channel to secure the rail member within the at least one channel.

11. The golf club head according to claim 1, wherein the rail member comprises:

at least a second extended rail; and a crossbar connecting the at least one extended rail to the at least a second extended rail.

12. The golf club head according to claim 11, wherein the at least one extended rail and the at least a second extended rail are spaced apart approximately 1 cm to 7 cm.

13. The golf club head of claim 1, wherein a first end of the at least one rail is ramped more steeply than a second end.

* * * * *